United States Patent [19]

Pollich

[11] Patent Number: 4,635,925

[45] Date of Patent: Jan. 13, 1987

[54] FEEDING DEVICE FOR SHEET PROCESSING MACHINES

[75] Inventor: Gerhard Pollich, Heidelberg, Fed. Rep. of Germany

[73] Assignee: Heidelberger Druckmaschinen AG, Heidelberg, Fed. Rep. of Germany

[21] Appl. No.: 732,502

[22] Filed: May 9, 1985

[30] Foreign Application Priority Data

May 12, 1984 [DE] Fed. Rep. of Germany ..... 3417764

[51] Int. Cl.[4] ..... B65H 9/06

[52] U.S. Cl. ..... 271/235; 271/237; 271/250

[58] Field of Search ..... 271/237, 234, 235, 250–252

[56] References Cited

U.S. PATENT DOCUMENTS

| | | | |
|---|---|---|---|
| 2,182,023 | 12/1939 | Harrold | 271/237 |
| 3,044,771 | 7/1962 | Norton | 271/234 |
| 3,108,800 | 10/1963 | Walsh | 271/235 |
| 4,060,237 | 11/1977 | Degen | 271/237 X |
| 4,541,623 | 9/1985 | Huerta | 271/237 X |

FOREIGN PATENT DOCUMENTS

| | | | |
|---|---|---|---|
| 405366 | 7/1966 | Switzerland | 271/237 |

*Primary Examiner*—Richard A. Schacher

*Attorney, Agent, or Firm*—Herbert L. Lerner; Laurence A. Greenberg

[57] ABSTRACT

A feeding device for a sheet processing machine for stream feeding to the sheet processing machine, in mutually overlapping relationship, equally thick sheets taken singly from a pile of the sheets, in combination with an alignment device for laterally aligning the sheets as they are being fed to the sheet processing machine, the feeding device includes a feed table having, together with the lateral alignment device, surfaces whereon the stream-fed sheets are supported, at least one section of the surfaces of the feed table and the lateral alignment device being disposed at a different level from that of another section thereof, at least while the sheets are being aligned, the difference in the levels being such that a preceding sheet being aligned, at the moment lies fully on a surface section of the lateral alignment device, the latter surface section being at substantially the same level as the upper surface of a leading portion of a next succeeding sheet underlying a trailing portion of the preceding sheet.

16 Claims, 8 Drawing Figures

FEEDING DEVICE FOR SHEET PROCESSING MACHINES

The invention relates to a feeding mechanism for sheet processing machines, especially printing machines, by means of which sheets taken singly from a pile thereof are stream fed on a feed table into the machine and are laterally aligned by an alignment device, which the sheets are being fed to the machine.

It is known that means must be provided in sheet processing machines, especially in printing machines, with which the sheets to be processed can be aligned to the precise position thereof before they enter the machine. In this regard, special importance is attached to lateral alignment. Socalled side alignment devices are provided for this purpose which convey the sheet against a stop, thereby determining its lateral position.

In the case of printing machines, this alignment must take place with extreme precision because otherwise undesirable register differences could occur with respect to the printed products. It must be possible to adjust the alignment devices to the size of the sheet, its thickness, its weight and to the friction dependent upon the surface properties thereof.

Essentially, two systems are in common use. In the case of one alignment device, operating on a purely mechanical basis, the draw roller presses the sheet, in accordance with the operating cycle, onto a counterpart which reciprocates transversely to sheet travel direction. In addition, pneumatically operating side alignment devices are known in which a suction slide or carriage acting on the underside of the sheet and essentially integrated into the feed table pulls or pushes the sheets to be aligned, in accordance with the working cycle, against a fixed marker.

In all cases, an unalterable prerequisite for ensuring that the aforementioned mechanism will function exactly is that the sheets lie completely flat over the entire surface at least in the working area thereof.

For the purpose of increasing hourly printing capacity, the sheets are often stream fed into the machine i.e. an underlapping or underlaying takes place. A result thereof is that the second sheet always lifts at the front markers the first sheet which is to be aligned laterally, precisely in the region of the alignment device of the leading edge of the second sheet is already located in the vicinity thereof.

Especially in the case of very thick sheets, this can lead to malfunctions in the feed movement or in the alignment procedure. Depending upon the type of alignment device used, the movement in the direction of the forward markers of the second sheet can be braked, otherwise there is the risk that, for example, it lifts the first sheet, which is in the alignment phase, away from the suction rail, thereby reducing its suction effect (dead air). (See FIG. 1) This situation can be the cause of the register differences during printing mentioned in the introduction hereto.

In order to exclude the possibility of such faults, a greater underlay spacing of a later arrival time for the sheets at the forward markers is often selected. The resulting disadvantages are primarily a higher impact speed at the forward or front markers, possibly also a reduced hourly sheet processing capacity and shorter alignment times at the forward markers.

Taking the foregoing disadvantages of the state of the art into consideration, it is an object of this invention to avoid these disadvantages and to construct a feeding device, including a feed table and an alignment device in such a way as to ensure a constant and unrestricted supply of sheets and trouble-free alignment procedure, especially by means of a side alignment device.

With the foregoing and other objects in view, there is provided, in accordance with the invention, a feeding device for a sheet processing machine for stream feeding to the sheet processing machine, in mutually overlapping relationship, equally thick sheets taken singly from a pile of the sheets, in combination with an alignment device for laterally aligning the sheets as they are being fed to the sheet processing machine, the feeding device comprising a feed table having, together with the lateral alignment device, surfaces whereon the stream-fed sheets are supported, at least one section of the surfaces of the feed table and the lateral alignment device being disposed at a different level from that of another section thereof, at least while the sheets are being aligned, the difference in the levels being such that a preceding sheet being aligned, at the moment lies fully on a surface section of the lateral alignment device, the latter surface section being at substantially the same level as the upper surface of a leading portion of a next succeeding sheet underlying a trailing portion of the preceding sheet.

In accordance with another feature of the invention, the feed table, upstream of the lateral alignment device, as viewed in travel direction of the sheets, is disposed lower by approximately the thickness of one sheet than a section of the feed table facing towards the sheet processing machine and containing the lateral alignment device.

In accordance with an added feature of the invention, the lateral alignment device is liftable a distance equal to approximately the thickness of one sheet away from the sheet-supporting surface of the feed table.

In accordance with an additional feature of the invention, the lateral alignment device and a forward section of the feed table are liftable together a distance equal to approximately the thickness of one sheet away from the sheetsupporting surface of a rear section of the feed table.

In accordance with a further feature of the invention, the difference in the levels is constant.

In accordance with still another feature of the invention, the difference in levels is introducible with clock control while a respective sheet is being aligned.

In accordance with still an additional feature of the invention, the lateral alignment device comprises a side marker and a draw roller with a cooperatively engageable draw rail.

In accordance with still an added feature of the invention, the lateral alignment device comprises a pneumatically operatable suction carriage for effecting the alignment movement, means for supplying suction to the suction carriage, and a suction carriage guide for guiding the suction carriage.

In accordance with still a further feature of the invention, the feed table is of one-piece construction and upstream of the lateral alignment device, in the sheet travel direction, and merges via an inclined region into a lower-lying section.

In accordance with again another feature of the invention, the feed table is of two-part construction, the division between the parts extending transversely to the sheet travel direction, a rear section of the feed table facing towards the pile of sheets being mounted so as to pivot about a pivot shaft located at an end of the rear section facing towards the sheet pile, the other end of the rear section facing towards the lateral alignment device and resting on a level adjustment mechanism.

In accordance with again an added feature of the invention, the feed table is flat over the entire surface thereof, and including a level adjustment mechanism exclusively in operative engagement with the lateral alignment device.

In accordance with again an additional feature of the invention, the feed table is of two-part construction, the division between the parts extending transversely to the sheet travel direction, a forward section of the feed table facing towards forward markers for aligning respective leading edges of the sheets, the forward section of the feed table being mounted so as to be pivotable about a pivot shaft located near an end of the forward section adjacent the forward markers, and including a level adjustment mechanism operatively engaging the lateral alignment device for pivoting the forward section of the feed table via and in conjunction with the lateral alignment device.

In accordance with still a further feature of the invention the level adjustment mechanism comprises a shaft extending transversely to sheet travel direction and having eccentric cams mounted thereon, the shaft being supported at given spaced locations thereof on a support rail via bearing brackets, the shaft and the support rail being mounted and fastened, respectively, to frames disposed at both sides of the sheet processing machine.

In accordance with still another feature of the invention, there are provided means for manually revolving the shaft.

In accordance with still an additional feature of the invention, there is provided a clock-controlled motor drive for revolving the shaft.

In accordance with still a further feature of the invention, there is provided an adjustment knob located on an end face of the shaft for manually adjusting the level adjustment mechanism, the adjustment knob having a knurled part and a leaf spring engaging in the depressions of the knurled part so as to lock the shaft in manually selected position.

In accordance with a concomitant feature of the invention, there is provided a motor drive unit for clock-controlled adjustment of the level adjustment mechanism, the motor drive unit being engageable with an end-face section of the shaft.

Other features which are considered as characteristic for the invention are set forth in the appended claims.

Although the invention is illustrated and described herein as embodied in feeding device for sheet processing machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
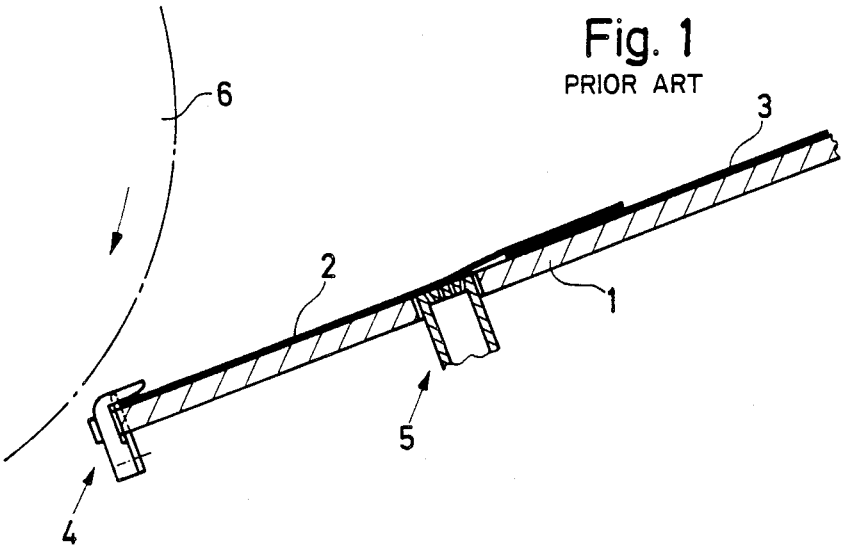
Fig. 1 PRIOR ART
FIG. 1 is a longitudinal, sectional view of a sheet feed table showing sheet-by-sheet or sheet stream feeding in accordance with the state of the art.

Referring now to the drawing and first, particularly, to FIG. 1 thereof, there is shown, a sheet feed table 1 exemplifying the state of the art. A first and a second sheet 2 and 3 are shown lying on the feed table. In order to illustrate the situation clearly, the sheet thickness is shown somewhat exaggeratedly. The first sheet 2 rests against front markers 4. After alignment at the front markers 4, the sheet 2 is to be aligned perpendicularly to the plane of the drawing by means of a lateral alignment device 5 before the sheet 2 is directed to a cylinder 6 of the printing machine for further processing. It can be clearly seen that the sheet 2 which is to be aligned does not fully rest on the alignment device 5. A consequence thereof is that the disadvantages set forth hereinabove in the introduction to this description then occur.

Figure 2:
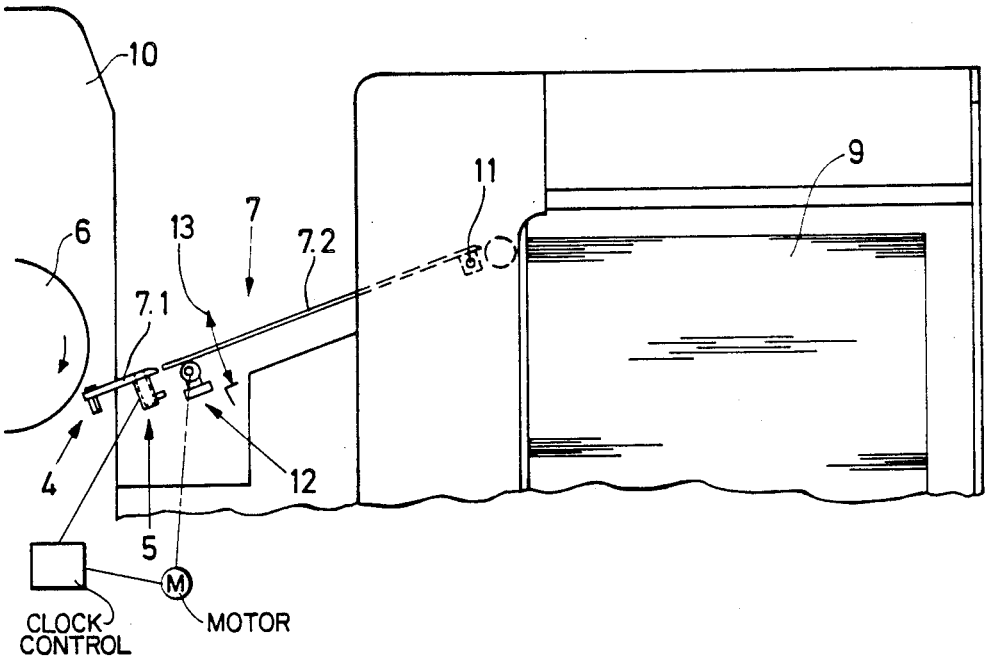
FIG. 2 is a front elevational view of the feeding system according to the invention wherein the feed table is divided in two with a vertically adjustable rear section.

In FIG. 2, an embodiment of the sheet feeding device of the invention is illustrated. The feed table 7 is of bipartite construction, the operation therebetween extending transversely to the sheet conveying direction, and features a forward section 7.1 and a rear section 7.2. The sheets taken one at a time from a pile 9 thereof are fed into the printing machine 10 by means of this feed table 7. The sheets are suitably aligned by the front markers 4 as well as the lateral alignment device 5.

The rear section 7.2 of the feed table 7 is mounted over the entire width thereof so as to be pivotable about a pivot shaft 11 at the end of the feed table 7 facing towards the pile 9. At the end of the feed table 7 facing towards the lateral alignment device 5, a level or elevational adjusting device 12 is provided with the aid of which, the feed table 7 is pivotable about the pivot shaft 11 in direction of the curved double-headed arrow 13.

Figure 3:
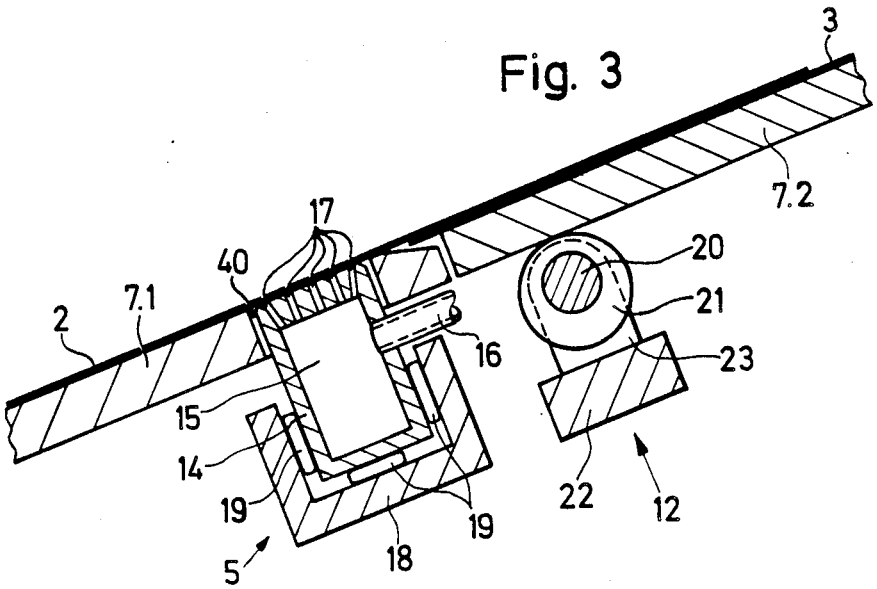
FIG. 3 is an enlarged, fragmentary cross-sectional view of FIG. 2 showing a level adjusting mechanism forming a part of the invention.

FIG. 3 is an enlarged view of the division or intersecting location of the forward and rear sections 7.1 and 7.2 of the feed table 7. The lateral alignment device 5 is constructed as a pneumatically operatable suction carriage 14 which is formed with a cavity 15 in the interior thereof and has a suction air supply 16. The entire suction carriage 14, during the alignment procedure, moves in a mounting body 8 with guide elements 19 in a direction perpendicular to the plane of the drawing i.e. perpendicular to the sheet conveying direction, in a recess 40 formed in the forward section 7.1 of the feed table 7. The drive necessary for this purpose and well known to persons skilled in the art is not shown in the interest of simplicity and clarity. The sheet 2 is firmly held by suction air openings 17, and suitably aligned. The level or elevational adjustment device 12 is primarily formed of a shaft 20 extending transversely to the sheet conveying direction. At given intervals (FIG. 4)

along the shaft 20, a number of eccentric cams 21 are mounted so as to be fixed against rotation relative to the shaft 20, on which, in turn, the aforementioned forward end of the feed-table rear section 7.2 rests. The shaft 20 is also supported on a support rail 22 via bearing brackets 23 which are also arranged at given intervals.

Figure 4:
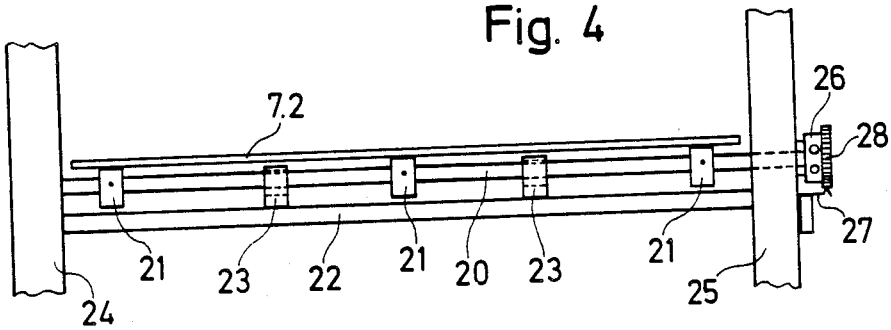
FIG. 4 is a reduced, fragmentary end view of FIG. 3 showing the level adjusting mechanism.

FIG. 4 shows, in this regard, the corresponding view opposite the sheet conveying direction. The shaft 20 and the support rail 22 are rotatably mounted and secured to the side frames 24 and 25. The end of the shaft 20 projecting beyond the frame 25 is provided, for the purpose of a manual adjustment, with an adjustment knob 26, by means of which the shaft and thereby the eccentric cams 21 can be turned, adjusting in this way the height of the rear section 7.2. A leaf spring 27 which engages in the depressions of a knurled part 28 of the adjustment knob 26 serves the purpose of locking the shaft in the respective manually selected position. A non-illustrated drive motor or transmission can engage at the corresponding location on the shaft 20, for example, in order to provide cycle or clock controlled adjustment. Of course, any other adequately acting level adjustment device would suitably replace the eccentric adjustment.

Figure 5:
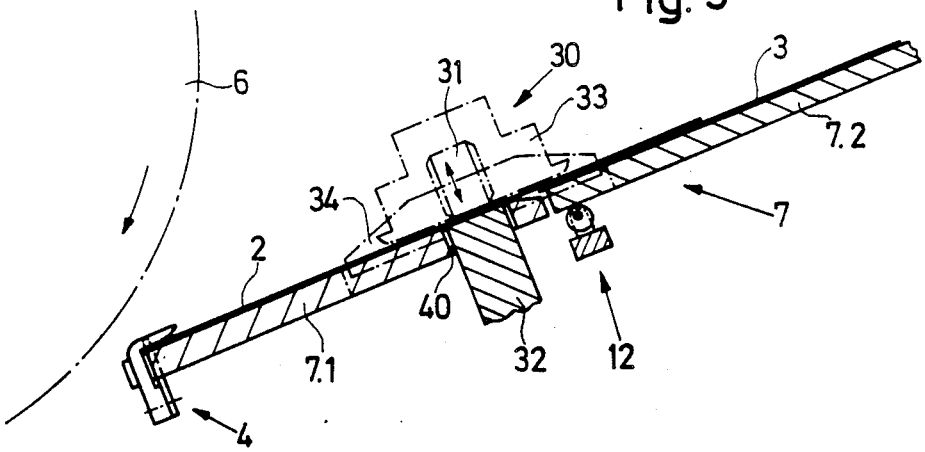
FIG. 5 is a view like that of FIG. 1 of a feed table with a mechanical alignment device constructed in accordance with the invention.

FIG. 5 shows a feed table 7 constructed in the manner aforedescribed. Only the lateral alignment device 30 can be alternatively constructed as a unit operating on a purely mechanical basis. The draw roller 31 which moves towards and away (double-headed arrow) in accordance with the sheet conveying cycle, presses the sheet 2, which is to be aligned, against a draw rail 32 inserted in a recess 40 formed in the forward section 7.1, the draw rail moving in a direction perpendicular to the plane of the drawing. A cover 33 and a side marker 34 are shown in phantom. For reasons of simplification, the respective drives are also not shown in FIG. 5, they are not a component part of the invention and are known to any person skilled in the art.

Figure 6:
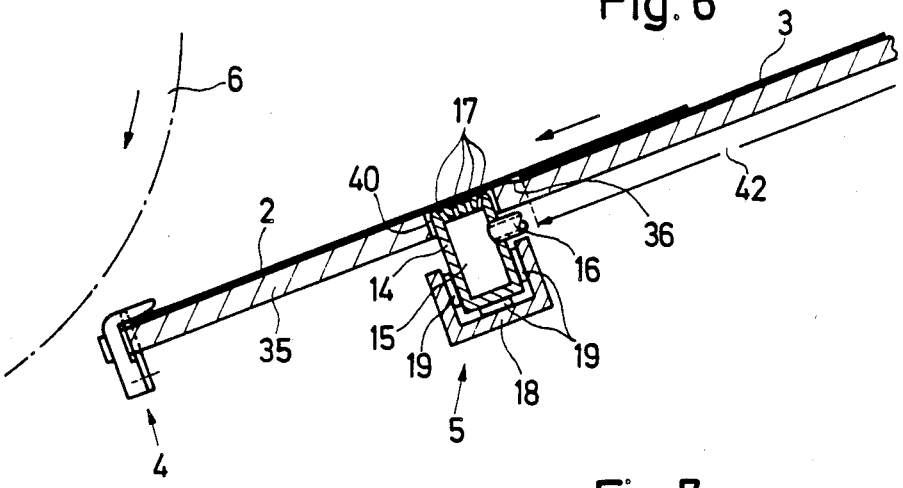
FIG. 6 is a view like that of FIG. 5 of a one-piece feed table with a lower-lying end or rear section.

FIG. 6 shows a further embodiment of the invention wherein the feed table 35 is formed in one piece and features, in the sheet conveying direction, in front of the lateral alignment device 5, a transition to a lower lying section 42 via a smooth incline 36 which permits undisturbed sheet transport. The depth measurement is determined and approximately corresponds, as in the aforedescribed embodiments, to the thickness of one sheet of paper for which the use of the device according to the invention is meaningful or sensible.

Figure 7:
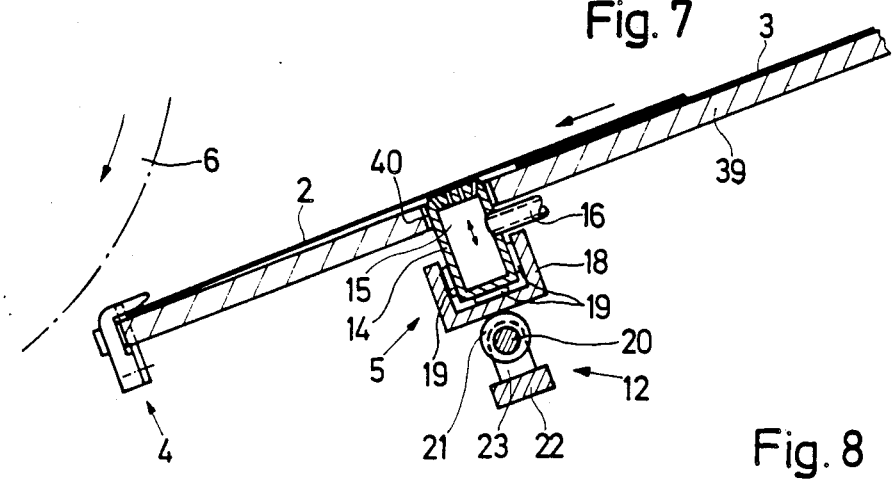
FIG. 7 is another view of FIG. 6 showing the addition of a vertically adjustable alignment device.

FIG. 7 shows a further embodiment wherein, in contrast with the embodiment of FIG. 6, the one-piece feed table 39 is completely planar or flat. In order to ensure trouble-free operation of the lateral alignment device 5, a level adjusting mechanism 12 acts upon the device itself, corresponding in function, for example, with that of the embodiment illustrated in FIGS. 3 and 4. In this way, the lateral alignment device 5 can be raised slightly (thickness of one sheet) stepwise during the alignment procedure, in order then to be lowered once again to the level of the feed table 39.

Figure 8:
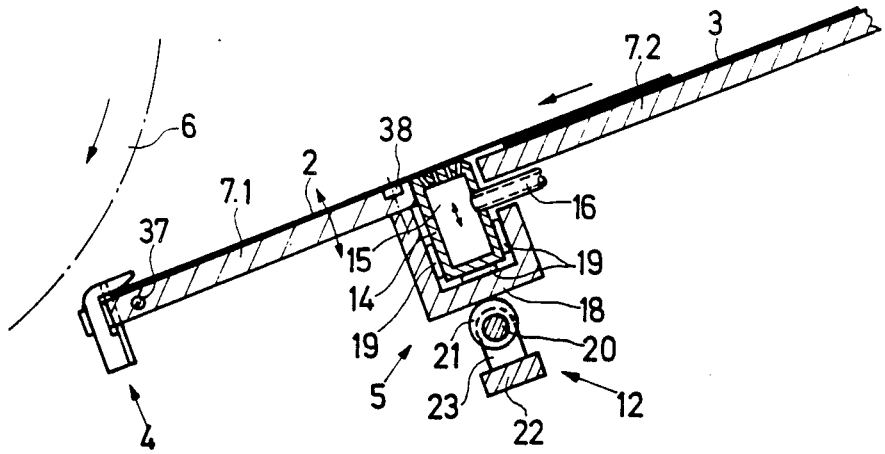
FIG. 8 is a view like those of FIGS. 5 to 7 of a feed table divided in two and having a front section vertically adjustable together with an alignment device.

In FIG. 8, the arrangement of a feed table 7 divided in two extends transversely to the sheet conveying direction. The forward section 7.1 facing towards the forward markers 4 is mounted so as to be pivotable about a pivot shaft 37 and actuated by the level adjusting mechanism 12 via the lateral alignment device 5 and together therewith. Connecting screws 38 establish the connection between the forward section 7.1 of the feed table 7 and the mounting body 18 of the alignment device 5, on which the level adjusting mechanism 12 acts.

Like all hereinafore-described embodiments, the embodiment of FIG. 8 can, of course, with slight design modifications, be used for the lateral alignment device 30 operating on a purely mechanical basis (draw roller 31, draw rail 32) as shown in FIG. 5.

The foregoing is a description corresponding in substance to German Application No. P 34 17 764.7, dated May 12, 1984, the International priority of which is being claimed for the instant application, and which is hereby made part of this application. Any material discrepancies between the foregoing specification and the aforementioned corresponding German application are to be resolved in favor of the latter.

I claim:

1. Feeding device for a sheet processing machine for stream feeding to the sheet processing machine, in mutually overlapping relationship, equally thick sheets taken singly from a pile of the sheets, in combination with an alignment device for laterally aligning the sheets as they are being fed to the sheet processing machine, the feeding device comprising a feed table having, together with the lateral alignment device, surfaces whereon the stream-fed sheets are supported, at least one section of the surfaces of said feed table and the lateral alignment device being disposed at a different level from that of another section thereof, at least while the sheets are being aligned, the difference in the levels being such that a preceding sheet being aligned at the moment lies flush against a surface section of the lateral alignment device until the preceding sheet is delivered to the sheet processing machine, the latter surface section being at substantially the same level as the upper surface of a leading portion of a next succeeding sheet underlying a trailing portion of the preceding sheet, said feed table, upstream of said lateral alignment device, as viewed in travel direction of the sheets, being disposed lower by approximately the thickness of one sheet than a section of the feed table facing towards the sheet processing machine and containing the lateral alignment device.

2. Feeding device according to claim 1 wherein the lateral alignment device is liftable a distance equal to approximately the thickness of one sheet away from the sheet-supporting surface of said feed table.

3. Feeding device according to claim 1, wherein the lateral alignment device and a forward section of the feed table are liftable together a distance equal to approximately the thickness of one sheet away from the sheet-supporting surface of a rear section of said feed table.

4. Feeding device according to claim 1 wherein the difference in the levels is constant.

5. Feeding device according to claim 4 wherein said feed table is of one-piece construction and upstream of the lateral alignment device, in the sheet travel direction, and merges via an inclined region into a lower-lying section.

6. Feeding device according to claim 4 wherein said feed table is of two-part construction, the division between the parts extending transversely to the sheet travel direction, a rear section of said feed table facing towards the pile of sheets being mounted so as to pivot about a pivot shaft located at an end of said rear section facing towards the sheet pile, the other end of said rear section facing towards the lateral alignment device and resting on a level adjustment mechanism.

7. Feeding device according to claim 1 wherein the difference in levels is introducible with clock control while a respective sheet is being aligned.

8. Feeding device according to claim 7 wherein said feed table is flat over the entire surface thereof, and including a level adjustment mechanism exclusively in operative engagement with said lateral alignment device.

9. Feeding device according to claim 1 wherein the lateral alignment device comprises a side marker and a draw roller with a cooperatively engageable draw rail.

10. Feeding device according to claim 1 wherein the lateral alignment device comprises a pneumatically operatable suction carriage for effecting the alignment movement, means for supplying suction to said suction carriage, and a suction carriage guide for guiding said suction carriage.

11. Feeding device for a sheet processing machine for stream feeding to the sheet processing machine, in mutually overlapping relationship, equally thick sheets taken single from a pile of the sheets, in combination with an alignment device for laterally aligning the sheets as they are being fed to the sheet processing machine, the feeding device comprising a feed table having, together with the lateral alignment device, surfaces whereon the stream-fed sheets are supported, at least one section of the surfaces of said feed table and the lateral alignment device being disposed at a different level from that of another section thereof, at least while the sheets are being aligned, the difference in the levels being such that a preceding sheet being aligned at the moment lies flush against a surface section of the lateral alignment device, the latter surface section being at substantially the same level as the upper surface of a leading portion of a next succeeding sheet underlying a trailing portion of the preceding sheet, the difference in the levels being constant, said feed table being of two-part construction, the division between the parts extending transversely to the sheet travel direction, a forward section of said feed table facing towards forward markers for aligning respective leading edges of the sheets, said foward section of said feed table being mounted so as to be pivotable about a pivot shaft located near an end of said forward section adjacent the forward markers, and including a level adjustment mechanism operatively engaging the lateral alignment device for pivoting said foward section of said feed table via and in conjunction with the lateral alignment device.

12. Feeding device for a sheet processing machine for stream feeding to the sheet processing machine, in mutually overlapping relationship, equally thick sheets taken single from a pile of the sheets, in combination with an alignment device for laterally aligning the sheets as they are being fed to the sheet processing machine, the feeding device comprising a feed table having, together with the lateral alignment device, surfaces whereon the stream-fed sheets are supported, at least one section of the surfaces of said feed table and the lateral alignment device being disposed at a different level from that of another section thereof, at least while the sheets are being aligned, the difference in the levels being such that a preceding sheet being aligned at the moment lies flush against a surface section of the lateral alignment device, the latter surface section being at substantially the same level as the upper surface of a leading portion of a next succeeding sheet underlying a trailing portion of the preceding sheet, said feed table is of two-part construction, the division between the parts extending transversely to the sheet travel direction, a rear section of said feed table facing towards the pile of sheets being mounted so as to pivot about a pivot shaft located at an end of said rear section facing towards the sheet pile, the other end of rear section facing towards the lateral alignment device and resting on a level adjustment mechanism, said level adjustment mechanism comprising a shaft extending traversely to sheet travel direction and having eccentric cams mounted thereon, said shaft being supported at given spaced locations thereof on a support rail via bearing brackets, said shaft and said support rail being mounted and fastened, respectively, to frames disposed at both sides of the sheet processing machine.

13. Feeding device according to claim 12 including means for manually revolving said shaft.

14. Feeding device according to claim 13 including an adjustment knob located on an end face of said shaft for manually adjusting said level adjustment mechanism, said adjustment knob having a knurled part and a leaf spring engaging in the depressions of said knurled part so as to lock said shaft in manually selected position.

15. Feeding device according to claim 12 including a clock-controlled motor drive for revolving said shaft.

16. Feeding device according to claim 15 including a motor drive unit for clock-controlled adjustment of said level adjustment mechanism, said motor drive unit being engageable with an end-face section of said shaft.

* * * * *